US011249416B2

(12) United States Patent
Hirata et al.

(10) Patent No.: US 11,249,416 B2
(45) Date of Patent: Feb. 15, 2022

(54) IMAGE FORMING APPARATUS

(71) Applicant: CANON KABUSHIKI KAISHA, Tokyo (JP)

(72) Inventors: Yuichiro Hirata, Susono (JP); Shinichi Hagiwara, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/235,111

(22) Filed: Apr. 20, 2021

(65) Prior Publication Data

US 2021/0255563 A1 Aug. 19, 2021

Related U.S. Application Data

(63) Continuation of application No. 16/895,131, filed on Jun. 8, 2020, now Pat. No. 11,016,409, which is a (Continued)

(30) Foreign Application Priority Data

Sep. 29, 2017 (JP) ..... JP2017-190419
Jun. 29, 2018 (JP) ..... JP2018-124769

(51) Int. Cl.
*G03G 15/08* (2006.01)
*G03G 15/02* (2006.01)
*G03G 15/04* (2006.01)

(52) U.S. Cl.
CPC ..... *G03G 15/081* (2013.01); *G03G 15/0233* (2013.01); *G03G 15/04* (2013.01); *G03G 15/04072* (2013.01)

(58) Field of Classification Search
CPC ..... G01R 15/0233; G01R 15/04; G01R 15/04072; G01R 15/081
See application file for complete search history.

(56) References Cited

U.S. PATENT DOCUMENTS 9,086,670 B2 7/2015 Matsuda
9,335,697 B2 5/2016 Yoshida
(Continued)

FOREIGN PATENT DOCUMENTS

JP 2014016538 A 1/2014
JP 2014016539 A 1/2014

OTHER PUBLICATIONS

Office Action issued in U.S. Appl. No. 16/136,610 dated Apr. 4, 2019.

(Continued)

*Primary Examiner* — Gregory H Curran
(74) *Attorney, Agent, or Firm* — Rossi, Kimms & McDowell LLP

(57) ABSTRACT

Provided is an image forming apparatus including an image bearing member, a charging member, an exposing member, a developer carrying member, a storage member to store a first lifetime threshold for the first image forming mode, a second lifetime threshold for the second image forming mode and a value related to a driving amount of the image bearing member. The image forming apparatus further includes a controller to (i) perform a first determination regarding the lifetime corresponding to the first mode based on the value related to the driving amount and the first lifetime threshold and (ii) perform a second determination regarding the lifetime corresponding to the second mode based on the value related to the driving amount and the second lifetime threshold, and a notifying unit to perform a notification based on a result of the first or second determination to the image bearing member.

8 Claims, 8 Drawing Sheets

Related U.S. Application Data continuation of application No. 16/715,444, filed on Dec. 16, 2019, now Pat. No. 10,719,029, which is a continuation of application No. 16/136,610, filed on Sep. 20, 2018, now Pat. No. 10,551,765.

(56) References Cited

U.S. PATENT DOCUMENTS

| | | | |
|---|---|---|---|
| 2007/0098459 | A1 | 5/2007 | Endo |
| 2010/0303492 | A1 | 12/2010 | Furukawa |
| 2011/0026082 | A1 | 2/2011 | Miyadera |
| 2011/0206432 | A1 | 8/2011 | Ninomiya |

OTHER PUBLICATIONS

Notice of Allowance issued in U.S. Appl. No. 16/136,610 dated Sep. 17, 2019.
Notice of Allowance issued in U.S. Appl. No. 16/715,444 dated Mar. 9, 2020.
Office Action issued in U.S. Appl. No. 16/895,131 dated Jul. 10, 2020.
Notice of Allowance issued in U.S. Appl. No. 16/895,131 dated Oct. 30, 2020.
Notice of Allowance issued in U.S. Appl. No. 16/895,131 dated Jan. 25, 2021.

IMAGE FORMING APPARATUS

BACKGROUND OF THE INVENTION

Field of the Invention

The present invention relates to an image forming apparatus, such as an electrophotographic copier and an electrophotographic printer.

Description of the Related Art

Some electrophotographic apparatuses have a plurality of image forming modes. For example, some full color electrophotographic apparatuses have a mode to print only mono-color (black) (hereafter called "mono-color mode").

In mono-color mode, a control to stop the drums and developing apparatuses corresponding to colors other than black may be performed to extend the lifetime of the electrophotographic apparatus. In this case, the degree of wear of a photosensitive drum differs depending on the mode.

In the case of an apparatus having a plurality of image forming modes like this, it is preferable to estimate the degree of wear of a drum for each image forming mode, and notify the user to replace each cartridge at an appropriate time. As for the techniques related to this aspect, Japanese Patent Application Publication No. 2014-16538 and No. 2014-16539 disclose image forming apparatuses, for example.

SUMMARY OF THE INVENTION

New image forming modes, in which an image forming apparatus operates under conditions that are different from conventional modes, are being proposed as image quality constantly improves and user applications expand. For example, a system in which resolution, contrast and the like are adjusted by independently setting a dark potential and a light potential for each image forming mode has been proposed, but an issue here is how the user receives notifications on the lifetime of the cartridge at an appropriate timing.

With the above problem of the prior art in view, it is an object of the present invention to provide a structure of an image forming apparatus which allows effectively using an image bearing member until an appropriate timing of the lifetime.

It is provided with a view to achieving one aspect as describe above an image forming apparatus having a plurality of image forming modes including a first image forming mode and a second image forming mode, including:

a rotatable image bearing member;

a charging member configured to charge a surface of the image bearing member;

an exposing member configured to expose the charged surface of the image bearing member to form an electrostatic latent image;

a developer carrying member configured to develop the electrostatic latent image formed on the surface by a developer;

a storage member configured to store a first lifetime threshold related to a lifetime corresponding to the first image forming mode, a second lifetime threshold related to a lifetime corresponding to the second image forming mode and a value related to a driving amount of the image bearing member;

a controller configured to (i) perform a first determination regarding the lifetime corresponding to the first image forming mode based on the value related to the driving amount and the first lifetime threshold and (ii) perform a second determination regarding the lifetime corresponding to the second image forming mode based on the value related to the driving amount and the second lifetime threshold; and a notifying unit configured to perform a first notification based on the first determination and perform a second notification based on the second determination to the image bearing member.

According to the present invention, a structure of an image forming apparatus which allows effectively using an image bearing member until an appropriate timing of the lifetime can be provided.

Further features of the present invention will become apparent from the following description of exemplary embodiments with reference to the attached drawings.

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

Embodiment 1

An image forming apparatus according to Embodiment 1 has a function to manage values related to a cumulative driving amount of a photosensitive drum 1, and determine the lifetime of the photosensitive drum 1. In concrete terms, the image forming apparatus holds a first lifetime threshold in a first image forming mode and a second lifetime threshold in a second image forming mode in a storage unit in advance, and collates the current film thickness state with the first and second lifetime thresholds, so as to perform notification on the lifetime of the photosensitive drum in each mode. Performing this lifetime determination corresponds to (i) performing a first determination on the lifetime in the first image forming mode based on the value related to the driving amount and the first lifetime threshold, and (ii) performing a second determination on the lifetime in the second image forming mode based on the value related to the driving amount and the second lifetime threshold.

General Configuration of Image Forming Apparatus

A general configuration of an electrophotographic image forming apparatus (an image forming apparatus) according to Embodiment 1 will be described first.

Figure 1:
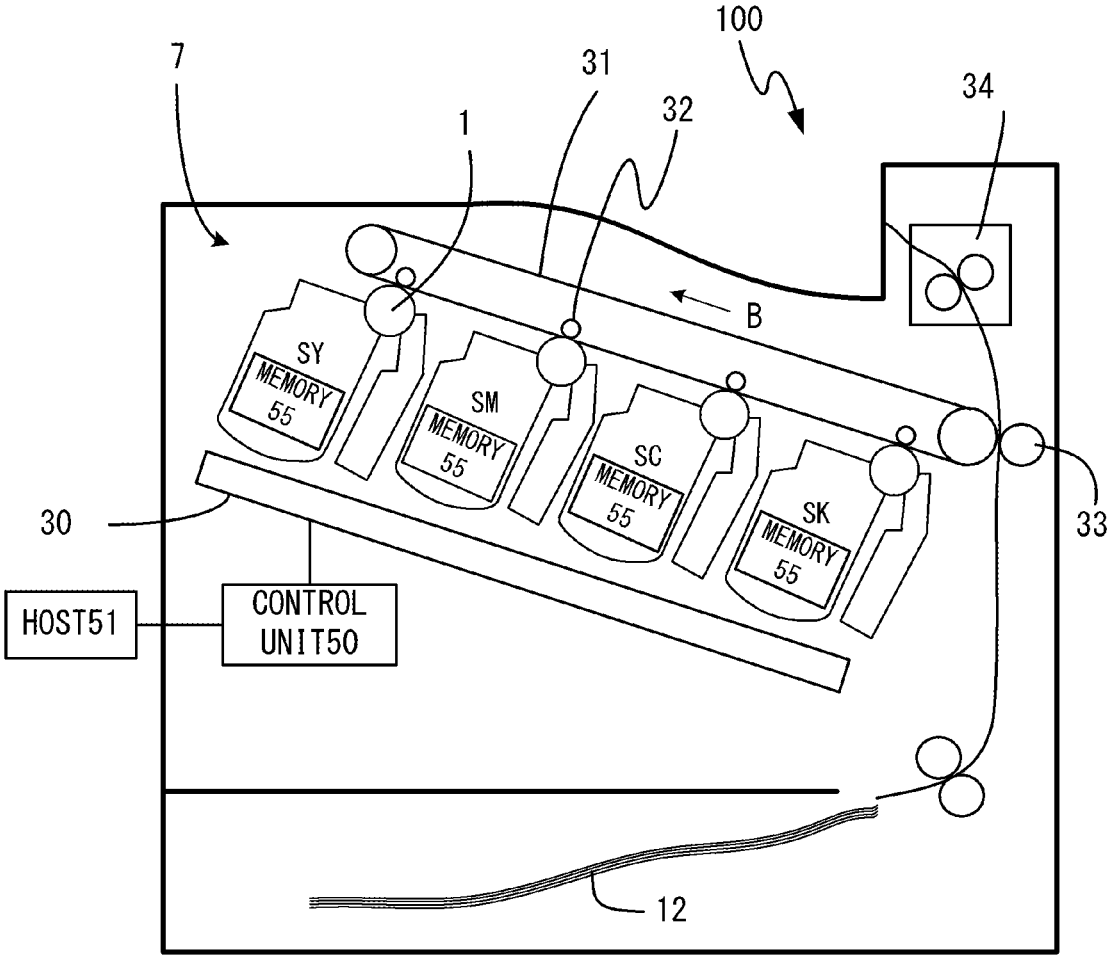
FIG. 1 is a schematic diagram of an image forming apparatus according to Embodiment 1.

FIG. 1 is a schematic cross-sectional view depicting the image forming apparatus 100 according to Embodiment 1. The image forming apparatus 100 according to Embodiment 1 is a full color laser printer using an inline system and an intermediate transfer system. The image forming apparatus 100 can form a full color image on a recording material (e.g. recording paper, plastic sheet, cloth) in accordance with the inputted image information. The image information is inputted from an image reading apparatus which is connected outside, or from a host device 51, such as a personal computer, which is communicably connected with the image forming apparatus 100.

The inputted image information is processed by a control unit 50, and the image is formed by the control unit 50 controlling each unit, which is described below. The control unit 50 is a processor, such as a CPU, but may be a designed dedicated circuit.

The image forming apparatus 100 has the first to fourth image forming units SY, SM, SC and SK to form the color images of yellow (Y), magenta (M), cyan (C) and black (K) respectively. In Embodiment 1, the first to fourth image forming units SY, SM, SC and SK are disposed in a line in the direction intersecting with the vertical direction.

In Embodiment 1, the configuration and operation of each first to fourth image forming units SY, SM, SC and SK are essentially the same, except for the color of the image to be formed. Therefore in the following, each image forming unit is described, omitting Y, M, C and K attached as the reference sign to identify the color of each element, unless a distinction is necessary.

In Embodiment 1, the process cartridge 7 of each color has an identical shape, and toner of each color of yellow (Y), magenta (M), cyan (C) and black (K) is stored in each process cartridge 7 respectively.

To transfer toner 10 developed by the process cartridge 7, the image forming apparatus has an intermediate transfer belt 31, which is an endless belt. The intermediate transfer belt 31 contacts the photosensitive drums 1 disposed for each color, and circulates (rotates) in the arrow B direction (counterclockwise). The intermediate transfer belt 31 is also installed around a driving roller, a secondary transfer counter roller, and a driven roller, which are support members (not illustrated).

On the inner peripheral surface side of the intermediate transfer belt 31, four primary transfer rollers 32 are disposed side by side, so as to face each photosensitive drum 1. Each primary transfer roller 32 presses the intermediate transfer belt 31 toward the photosensitive drum 1, whereby a primary transfer portion, where the intermediate transfer belt 31 and the photosensitive drum 1 contact, is formed. To each primary transfer roller 32, a bias, having a reversed polarity of the normal charging polarity of the toner, is applied from a primary transfer bias power supply (high voltage power supply), which is not illustrated. Thereby the toner image on the photosensitive drum 1 is transferred onto the intermediate transfer belt 31 (primary transfer).

On the outer peripheral surface side of the intermediate transfer belt 31, a secondary transfer roller 33 is disposed at a position facing a secondary transfer counter roller (not illustrated). The secondary transfer roller 33 press-contacts the secondary transfer counter roller (not illustrated) via the intermediate transfer belt 31, and forms a secondary transfer portion where the intermediate transfer belt 31 and the secondary transfer roller 33 contact. To the secondary transfer roller 33, a bias, having a reversed polarity of the normal charging polarity of the toner, is applied from a secondary transfer bias power supply (high voltage power supply), which is not illustrated. Thereby the toner image on the intermediate transfer belt 31 is transferred to the recording material 12 (secondary transfer).

Figure 2:
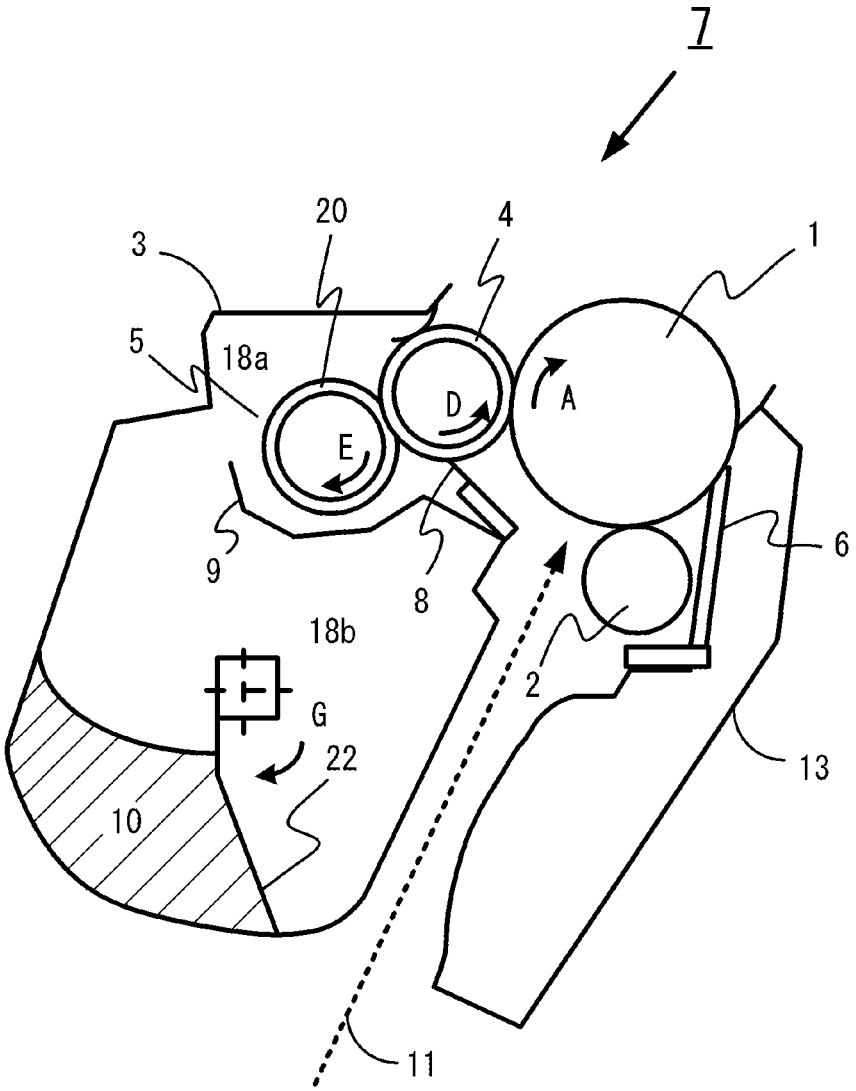
FIG. 2 is a schematic diagram depicting a developing apparatus and a process cartridge according to Embodiment 1.

FIG. 2 is a schematic diagram of the process cartridge 7. When an image is formed, the surface of the photosensitive drum 1 is uniformly charged by a charging roller 2, which is disposed to contact the photosensitive drum 1. Then the surface of the charged photosensitive drum 1 is scanned and exposed in accordance with the image information by a laser light 11 emitted from a scanner unit 30. Thereby an electrostatic image, in accordance with the image information, is formed on the photosensitive drum 1.

The electrostatic image formed on the photosensitive drum 1 is developed into a toner image by the developing unit 3. The toner image formed on the photosensitive drum 1 is transferred onto the intermediate transfer belt 31 by a function of the primary transfer roller 32 (primary transfer).

In the process of forming a full color image, the above-mentioned processes are performed sequentially by the first to fourth image forming units SY, SM, SC and SK, and a toner image having each color is sequentially superimposed on the intermediate transfer belt 31 in the primary transfer.

Then the recording material 12 is transported to the secondary transfer unit synchronizing with the movement of the intermediate transfer belt 31. The four color toner images on the intermediate transfer belt 31 are secondarily transferred onto the recording material 12 in batch by the function of the secondary transfer roller 33, which is in contact with the intermediate transfer belt 31 via the recording material 12.

Then the recording material 12, on which the toner images are transferred, is transported to a fixing apparatus 34. The toner images are fixed to the recording material 12 by the fixing apparatus 34, applying heat and pressure to the recording material 12.

The primary transfer residual toner, which remains on the photosensitive drum 1 after the primary transfer step, is removed and collected by a cleaning member 6. The secondary transfer residual toner, which remains on the intermediate transfer belt 31 after the secondary transfer step, is cleaned by an intermediate transfer belt cleaning apparatus (not illustrated).

The image forming apparatus 100 can also forma single color of multi-color image using only one image forming unit, or only some (not all) of the image forming units, as desired.

Configuration of Process Cartridge

A detailed configuration of the process cartridge 7 installed in the image forming apparatus 100 of Embodiment 1 will be described next. In Embodiment 1, the configuration and operation of each process cartridge 7 for each color are essentially the same, except for the type (color) of the stored toner.

FIG. 2 is a schematic cross-sectional view of the process cartridge 7 of Embodiment 1 when viewed in the longer direction of the photosensitive drum 1 (rotation axis line direction). The position of the process cartridge 7 in FIG. 2 is a position when the process cartridge 7 is installed in the image forming apparatus, and the following description on the positional relationship and direction of each member of the process cartridge is based on this position.

The process cartridge 7 is configured by integrating a photosensitive unit 13 which includes the photosensitive drum 1 and the like, and a developing unit 3 which includes a developing roller 4 and the like.

In the photosensitive unit 13, the photosensitive drum 1 is rotatably installed via a bearing (not illustrated). The photosensitive drum 1 is rotationally driven in the arrow A direction (clockwise) in accordance with the image forming operation by the driving force of a driving motor (not illustrated) transferring to the photosensitive unit 13.

The photosensitive drum 1 has a 24 mm outer diameter and rotates at 40 rpm. In Embodiment 1, the photosensitive drum 1 plays a central role in the image forming process, and is an organic photosensitive drum 1. This photosensitive drum 1 is generated by sequentially coating an undercoating layer, a carrier generating layer and a carrier transfer layer (hereafter "CT layer"), which are functional films made of organic materials, on the outer peripheral surface of an aluminum cylinder. In Embodiment 1, the film thickness of the CT layer is 12 μm.

In the photosensitive unit 13, the cleaning member 6 and the charging roller 2 are disposed so as to contact the peripheral surface of the photosensitive drum 1. The transfer residual toner, which is removed from the surface of the photosensitive drum 1 by the cleaning member 6, drops and is stored in the waste toner container inside the photosensitive unit 13.

The charging roller 2 is constituted of a core metal and a conductive rubber portion which covers the outer peripheral surface of the core metal, and is rotated by pressing the roller portion of the conductive rubber against the photosensitive drum 1.

In a charging step, a predetermined DC voltage is applied to the core metal of the charging roller 2 to charge the photosensitive drum 1, thereby a uniform dark potential (Vd) is generated on the surface of the photosensitive drum 1. The laser light, which is emitted from the abovementioned scanner unit 30, forms a spot pattern and exposes the photosensitive drum 1 corresponding to the image data, and electric charges on the surface are lost in the exposed portion due to carriers from the carrier generating layer, causing potential to drop. As a result, on the photosensitive drum 1, an electrostatic latent image of a predetermined light potential (Vl) is formed on the exposed portion, and an electrostatic latent image of the predetermined dark potential (Vd) is formed on the unexposed portion.

The image forming apparatus according to Embodiment 1 has two image forming modes.

The first image forming mode (image forming mode 1) is a standard printing mode, in which the charging bias V is −1100 V, Vd is −500 V and Vl is −100 V.

The second image forming mode (image forming mode 2) is a high resolution printing mode, in which the charging bias V is −1600 V, Vd is −800 V and Vl is −100 V. In the image forming mode 2, fine lines can be reproduced better since the potential difference between the dark potential Vd and the light potential Vl is large. As described above, in Embodiment 1, a plurality of modes having mutually different absolute values of the potential difference of the latent image (that is, the potential difference between the dark potential and the light potential) can be set.

The developing unit 3 has: a developing roller 4 (developer carrying member) to carry the toner 10; and a developing chamber in which a toner supply roller 20 to coat the toner 10 on the developing roller 4 is disposed.

Further, the developing unit 3 has a toner containing chamber **18*b*, in which a toner containing unit (developer containing unit) 18*a* to contain toner 10 is disposed below the toner supply roller 20** in the gravity direction. In Embodiment 1, toner, of which degree of agglomeration is 5% to 40% in the initial state, is used. Using toner with this degree of agglomeration is preferable in order to ensure flowability of toner.

The degree of agglomeration of the toner is measured as follows.

For the measuring device, a powder tester (made by Hosokawa Micron Corp.), which includes a digital vibration meter (Model 1332, made by Showa Sokki Corp.), is used.

The measurement method is as follows. On a vibration table, sieves of 390 mesh, 200 mesh and 100 mesh are stacked up in the sequence of smaller openings (in other words, the 100 mesh sieve is at the top).

On the sieve of 100 mesh that is set, an accurately measured 5 g sample (toner) is placed, and the value of the displacement of the digital vibration meter is adjusted to 0.60 mm (peak-to-peak), and vibration is applied for 15 seconds. Then the mass of the sample remaining on each sieve is measured, and the degree of agglomeration is determined using the following formula.

Each measurement sample in this case is left under a 23° C. and 60% RH environment for 24 hours in advance, and the measurement is performed under a 23° C. and 60% RH environment.

The degree of agglomeration (%)=(mass of remaining sample on 100 mesh sieve/5 g)×100+(mass of remaining sample on 200 mesh sieve/5 g)×60+(mass of remaining sample on 390 mesh sieve/5 g)×20

The description on the configuration of the process cartridge will be continued.

The toner supply roller 20 rotates while forming a toner nip portion (portion to hold toner between the developing roller 4 and the toner supply roller 20) with the developing roller 4.

A stirring/transporting member 22 is disposed inside the toner containing chamber **18*b*. The stirring/transporting member 22 is a member to stir the toner contained in the toner containing chamber 18*b*, and transport the toner toward the upper part of the toner supply roller 20 in the arrow G direction in FIG. 2**. In Embodiment 1, the stirring/transporting member is rotating at 30 rpm.

A developing blade 8 is disposed below the developing roller 4, and is a unit to contact the developing roller and regulate the coating amount of the toner supplied by the toner supply roller 20, and to charge the developing roller 4. In this Embodiment 1, a thin plate, which is a 0.1 mm thick leaf spring made by SUS, is used for the developing blade 8, and utilizing the spring elasticity of the thin plate, contact pressure is generated so that the surface of the developing blade 8 contacts the toner and the developing roller 4. The developing blade is not limited to this, and may be a thin metal plate made of phosphor bronze or aluminum. A thin film of polyamide elastomer, urethane rubber, urethane resin or the like may be coated on the surface of the developing blade 8.

The toner is frictionally charged by the rubbing between the developing blade 8 and the developing roller 4, and at the same time, the thickness of the layer of the toner is regulated thereby. In Embodiment 1, a predetermined voltage is applied to the developing blade 8 from a blade bias power supply (not illustrated), so as to stabilize the toner coating. In the image forming mode 1, V=−500 V is applied as the blade bias. In the image forming mode 2, V=−800 V is applied as the blade bias.

The developing roller 4 and the photosensitive drum 1 rotate respectively so that the respective surfaces move to the same direction (upward direction in Embodiment 1) in the portion where the developing roller 4 and the photosensitive drum 1 face each other.

In Embodiment 1, the developing roller 4 is disposed in contact with the photosensitive drum 1, but the developing roller 4 may be disposed in proximity to the photosensitive drum 1 at a predetermined space.

The toner, which is negatively charged with respect to the predetermined DC bias applied to the developing roller 4 by the frictional charging, is transferred only to the light potential portions due to the potential difference in the developing portion contacting the photosensitive drum 1. Thereby the electrostatic latent image is developed.

In the image forming mode 1, ΔV=200 V of potential difference from the light potential portion (hereafter "developing contrast") is formed by applying Vdc=−300 V to the developing roller, whereby the toner image is formed. In the image forming mode 2, ΔV=500 V of developing contrast is formed by applying Vdc=−600 V to the developing roller, whereby the toner image is formed.

The toner supply roller 20 and the developing roller 4 rotate in the directions such that each surface moves to the upper end to the lower end of the nip portion. In other words, the toner supply roller 20 rotates in the arrow E direction (clockwise) in FIG. 2, and the developing roller 4 rotates in the arrow D direction. The toner supply roller 20 is an elastic sponge roller created by forming a foamed layer on the outer periphery of a conductive core metal. The toner supply roller 20 and the developing roller 4 contact each other with a predetermined penetration amount, that is, depression amount ΔE when the toner supply roller 20 is depressed by the developing roller 4. The toner supply roller 20 and the developing roller 4 rotate in opposite directions at this contact portion, and by this operation, the toner supply roller 20 supplies toner to the developing roller 4. At this time, the toner supply amount to the developing roller 4 can be adjusted by adjusting the potential difference between the toner supply roller 20 and the developing roller 4. In both the image forming modes 1 and 2, the rotating speed of the toner supply roller is 80 rpm, the rotating speed of the developing roller is 100 rpm, and a DC bias is applied to the toner supply roller 20 so as to generate the same potential as the developing roller 4. In this case, the peripheral speed difference of the photosensitive drum 1 and the developing roller 4 is 156%. Table 1 indicates the relationship of the applied bias between the image forming modes 1 and 2.

TABLE 1

| | IMAGE FORMING MODE 1 | IMAGE FORMING MODE 2 |
|---|---|---|
| DARK POTENTIAL | −500 V | −800 V |
| LIGHT POTENTIAL | −100 V | −100 V |
| CHARGING BIAS | −1100 V | −1400 V |
| BLADE BIAS | −500 V | −800 V |
| DEVELOPING BIAS | −300 V | −600 V |
| DEVELOPING CONTRAST | −200 V | −500 V |

In Embodiment 1, the developing roller 4 and the toner supply roller 20 both have a 15 mm outer diameter, and the penetration amount of the toner supply roller 20 to the developing roller 4, that is, the depression amount ΔE when the toner supply roller 20 is depressed by the developing roller 4, is set to 1.0 mm.

The toner supply roller 20 according to Embodiment 1 has a conductive support member and a foamed layer which is supported by the conductive support member. In concrete terms, the toner supply roller 20 has: a core metal electrode 20*a* which is the conductive member, and has a $5 (mm) outer diameter; and a foamed urethane layer 20*b* (foamed layer) constituted by open cell foam where bubbles coalesce, which is disposed around the core metal electrode 20*a*. This toner supply roller 20 rotates in the direction E in FIG. 2.

Photosensitive Drum Lifetime Estimating Unit

A photosensitive drum lifetime estimating unit, which is a characteristic of the present invention, will be described next in detail.

The image forming apparatus 100 according to Embodiment 1 has a memory 55 (storage unit) which stores threshold of a wear amount of the CT layer (organic photosensitive layer on the surface of the image bearing member) of the photosensitive drum 1. This memory 55 stores a plurality of thresholds in association with the settable image forming modes.

Further, the image forming apparatus 100 according to Embodiment 1 includes a photosensitive drum lifetime determining unit (comparing unit), which estimates the wear amount of each CT layer respectively, and determines the lifetime of the drum by comparing the estimated wear amount and the plurality of thresholds stored in the memory 55. In concrete terms, when the estimated wear amount reaches a threshold of a certain image forming mode, the photosensitive drum lifetime determining unit notifies the user that the drum lifetime ended in this image forming mode.

Figure 3:
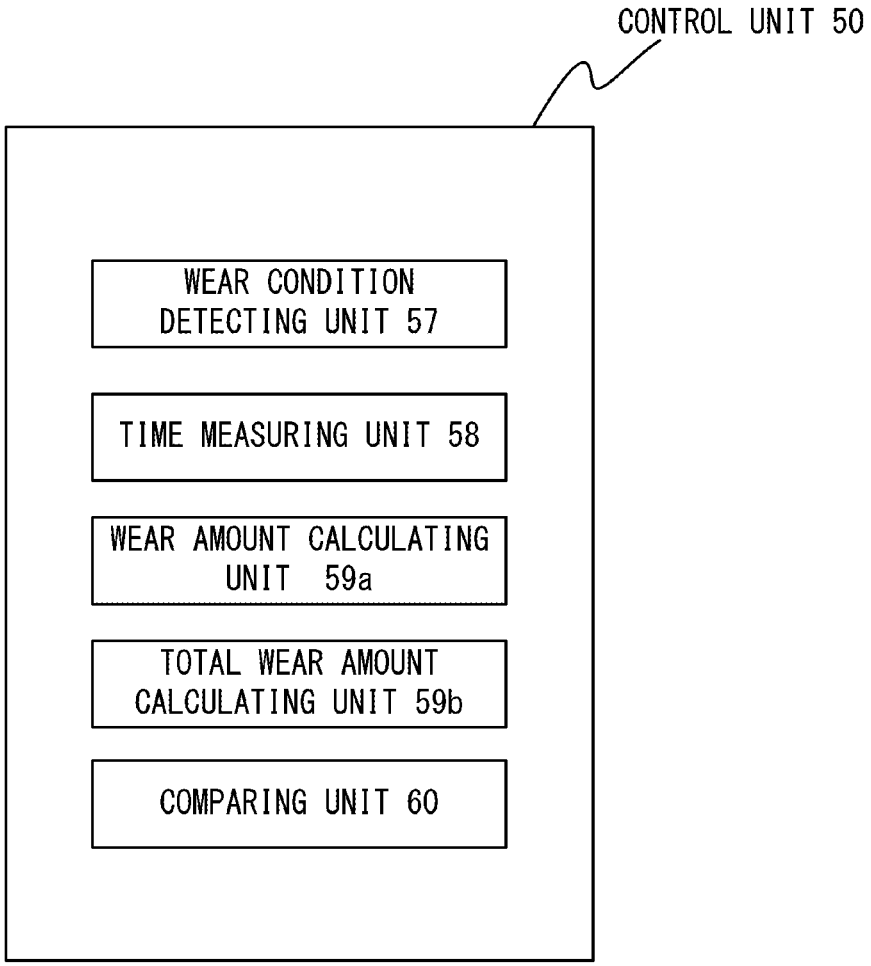
FIG. 3 is a diagram depicting functional blocks included in a control unit 50.

In Embodiment 1, the control unit 50 of the image forming apparatus 100 functions as this photosensitive drum lifetime determining unit. The control unit 50 also functions as a wear condition detecting unit 57, a time measuring unit 58, a wear amount calculating unit 59*a*, a total wear amount calculating unit 59*b* and a comparing unit 60, which will be described later. FIG. 3 is a diagram depicting the functional blocks included in the control unit 50.

The memory 55 is installed in each of the process cartridges SY, SM, SC and SK having a respective color.

In Embodiment 1, the wear amount calculating unit 59*a* estimates the wear amount at the longitudinal center of the photosensitive drum 1 during image forming operation. Further, the total wear amount calculating unit 59*b* calculates the total wear amount from the initial film thickness. The memory 55 stores the lifetime threshold in the image forming mode 1 and the lifetime threshold in the image forming mode 2, and when the calculated total wear amount reaches either one of the thresholds, the user is notified that the lifetime of the photosensitive drum 1 ended.

To calculate the total wear amount of the photosensitive layer, the wear amount per unit time must be stored for each image forming mode. Then the time of operation in each image forming mode is calculated and multiplied by the wear amount per unit time. The total wear amount is determined by integrating the wear amount determined like this, and is compared with a threshold.

The wear amount per unit time changes depending on the discharge amount of the charging roller to the photosensitive drum 1.

Here a method of determining the wear amount per unit time in each image forming mode based on experiment will be described. In Embodiment 1, the image forming apparatus was operated continuously for 6 hours under the above-mentioned conditions in the image forming modes 1 and 2. Then using a film thickness measuring device (Permascope, made by Fisher), the film thicknesses at the longitudinal center of the photosensitive drum 1 was measured before and after experiment, and the difference thereof was determined.

First, the film thickness required for the CT layer of the photosensitive drum 1 in the image forming mode 1 was checked by experiment. As a result, it was observed that when the film thickness is less than 7 μm, the dark decay of VD of the photosensitive drum 1 accelerates, particularly under a high temperature and high humidity environment of at least 30° C./80%. This resulted in the generation of background fogging, that is, the optimum contrast between the developing bias and VD cannot be maintained after charging because of the drop in potential in the developing roller 4, and toner is developed in the VD portion. Toner leakage also occurred. Therefore the film thickness at the end of the photosensitive drum lifetime in the image forming mode 1 is set to 7.0 μm.

In the image forming mode 2, toner leakage occurred when the film thickness of the CT layer of the photosensitive drum 1 is 9.0 μm. This is because in the image forming mode 2, the bias applied to the charging roller 2 is high, and the discharge current increases, which easily causes dielectric breakdown.

Further, in terms of the relationship between the CT film thickness and the dielectric breakdown, leakage occurs when the CT film thickness is 9.0 μm or less in the image forming mode 2, as indicated in Table 2. Based on this result, the film thickness at the end of the photosensitive drum lifetime in the image forming mode 2 is set to 9.0 μm.

TABLE 2

| CT FILM THICKNESS | IMAGE FORMING MODE 1 | IMAGE FORMING MODE 2 |
|---|---|---|
| 10 μm | NOT OCCURRED | NOT OCCURRED |
| 9 μm | NOT OCCURRED | LEAKAGE OCCURRED |
| 8 μm | NOT OCCURRED | LEAKAGE OCCURRED |
| 7 μm | LEAKAGE OCCURRED | LEAKAGE OCCURRED |

Table 3 indicates the result of calculating the wear amount (m) after six hours, and the wear amount per unit time (one second) (hereafter "wear coefficient") in the image forming modes 1 and 2.

TABLE 3

| | IMAGE FORMING MODE 1 | IMAGE FORMING MODE 2 |
|---|---|---|
| TOTAL WEAR AMOUNT AFTER 6 HOURS [μm] | 1.182 | 1.242 |
| WEAR COEFFICIENT [μm/sec] | 0.0000328 (c1) | 0.0000345 (c2) |

The total wear amount in each mode can be calculated by multiplying the wear coefficient calculated like this by the operation time in each mode.

The calculation of estimating the drum lifetime and the determination to notify the lifetime according to Embodiment 1 will be described next with specifics.

The memory 55, which is installed in each process cartridge SY, SM, SC and SK having a respective color, stores a plurality of thresholds on the wear amount of the CT layer (organic photosensitive layer) of the photosensitive drum 1. In Embodiment 1, a threshold S1 corresponding to the image forming mode 1 and a threshold S2 corresponding to the image forming mode 2 are stored as the thresholds of the wear amount of the photosensitive drum 1.

In Embodiment 1, the difference between the initial film thickness and the film thickness at the end of lifetime (that is, the upper limit value of the wear amount) is stored as the lifetime threshold.

In concrete terms, the lifetime threshold S1 in the image forming mode 1 is 5 μm (=initial film thickness 12 μm−film thickness at end of lifetime 7 μm), and the lifetime threshold S2 in the image forming mode 2 is 3 μm (=initial film thickness 12 μm−film thickness at end of lifetime 9 μm). Further, the wear coefficients in each mode indicated in Table 3 are stored.

The memory 55 also stores the total wear amount, which is the result of calculation by the later mentioned total wear amount calculating unit 59*b*. In this description, ST indicates the total wear amount.

First, the wear condition detecting unit 57 detects whether the current conditions matches the image forming mode 1 or 2.

Then the time measuring unit 58 calculates the operation time in the image forming mode 1 or 2. The operation time in each image forming mode is based on what is stored in the apparatus as the operation history.

The operation history of the apparatus is not limited to the operation time. For example, in the case of the operation history of the photosensitive drum 1, a number of rotations of the photosensitive drum 1 may be used. A number of pages when the image forming apparatus formed images on the recording sheets may be used. Further, a power supplying time to the image forming apparatus during operation in each image forming mode may be used.

Then the wear amount calculating unit 59 calculates the wear amount by multiplying the calculation result of the operation time by the wear coefficient corresponding to each mode. This calculation is performed every time operation in each mode ends. The name of the wear coefficient in each mode is indicated in parenthesis in Table 3.

Then the total wear amount calculating unit 59*b* adds the value calculated by the wear amount calculating unit 59*a* to the integrated wear amount calculated thus far. Then the comparing unit 60 compares the calculation result of the total wear amount and the lifetime threshold in the memory 55, and determines that the calculation result of the total wear amount is the lifetime threshold or more.

The following Table 4 indicates each item and the names thereof.

TABLE 4

| | NAME |
|---|---|
| TOTAL WEAR AMOUNT | ST |
| WEAR COEFFICIENT IN IMAGE FORMING MODE 1 | c1 |
| WEAR COEFFICIENT IN IMAGE FORMING MODE 2 | c2 |
| DRIVING TIME IN IMAGE FORMING MODE 1 | t1 |
| DRIVING TIME IN IMAGE FORMING MODE 2 | t2 |

TABLE 4-continued

| | NAME |
|---|---|
| LIFE THRESHOLD IN IMAGE FORMING MODE 1 (= INITIAL FILM THICKNESS − FILM THICKNESS AT END OF LIFE) | S1 |
| LIFE THRESHOLD IN IMAGE FORMING MODE 2 (= INITIAL FILM THICKNESS − FILM THICKNESS AT END OF LIFE) | S2 |

The calculation of the wear amount performed by the wear amount calculating unit 59*a* and the lifetime determination will be described next with reference to the flow chart in FIG. 4.

Figure 4:
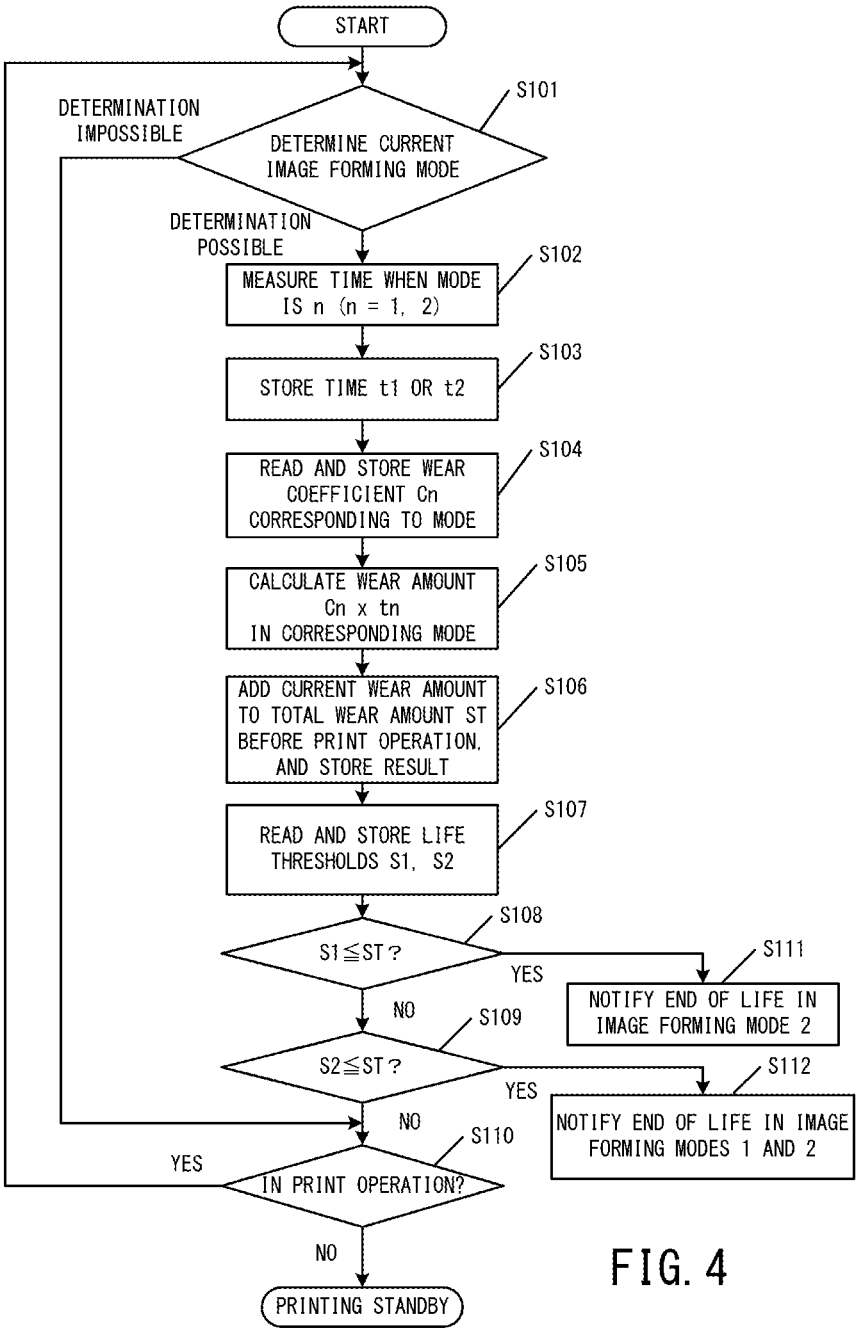
FIG. 4 is a flow chart depicting a processing to determine the lifetime of a drum according to Embodiment 1.

FIG. 4 is a flow chart depicting the operation of the image forming apparatus 100 to determine the lifetime of the photosensitive drum after the image forming apparatus 100 received the print request in the print operation standby state. To determine whether the image forming apparatus 100 is in print operation or not, which will be described later, a charging current detecting circuit, included in a charging bias applying circuit (not illustrated), detects the charging current, and determines whether the charging roller 2 is discharging.

First, in step S101, the wear condition detecting unit 57 determines the current image forming mode. If the image forming mode is determined, processing advances to step S102. If the image forming mode cannot be determined, processing advances to step S110.

In step S102, the time operating under the mode n (n is either 1 or 2), determined in step S101, is measured by the time measuring unit 58. The measured driving time tn is stored in the wear amount calculating unit 59*a* (step S103).

In step S104, the image forming apparatus 100 reads the wear coefficient cn corresponding to the determined mode n (n=1, 2) from the memory 55, and stores the wear coefficient cn in the wear amount calculating unit 59*a*.

In step S105, the wear amount calculating unit 59*a* calculates the wear amount in each image forming mode cn×tn (n=1, 2).

In step S106, the total wear amount calculating unit 59*b* reads the total wear amount ST before the print operation from the memory 55, and adds the wear amount calculated this time to update the total wear amount ST, and stores the result to the memory 55 and the comparing unit 60. The updated ST after the update is given by the following expression.

$$\text{Updated } ST=ST+cn\times tn \quad (n=1,2)$$

In step S107, the comparing unit 60 reads the lifetime thresholds S1 and S2 from the memory 55, and stores these lifetime thresholds.

In step S108, the comparing unit 60 determines whether S1≤ST. If YES, processing advances to step S11. If NO, processing advances to step S109.

In step S109, the comparing unit 60 determines whether S2≤ST. If YES, processing advances to step S112. If NO, processing advances to step S110.

If processing advances to step S110, the lifetime of the photosensitive drum is not notified. Here it is determined whether the image forming apparatus 100 is in the print operation, and if YES, processing advances to step S101. If NO, the image forming apparatus 100 enters the print operation standby state.

In step S112, operation of the image forming apparatus 100, such as driving and applying bias, is sequentially stopped, and information that the drum lifetime ended (lifetime ended in both first and second image forming modes) is displayed on the display unit 21 (not illustrated) based on the instruction of the control unit 50. For example, a text message is displayed. Instead of the display unit 21, a speaker, to notify the information by voice, may be used as the notifying unit.

Further, in step S111, operation of the image forming apparatus 100, such as driving and applying bias, is sequentially stopped, and information that the drum lifetime ended (lifetime ended in the second image forming mode) is displayed on the display unit 21 based on the instruction of the control unit 50. After the notification in step S111, the control unit 50 may allow operation in the image forming mode 2 if the user instructs it, or may disable operation in the image forming mode 2 regardless the instruction from the user.

Using this photosensitive drum lifetime estimating method, the image forming apparatus 100 was operated in each of the following paper feed modes, and a number of pages and the total wear amount at the end of the drum lifetime were checked.

Paper feed mode 1: uses only image forming mode 1

Paper feed mode 2: uses only image forming mode 2

Paper feed mode 3: switches to image forming mode 3 after printing 10,000 pages in image forming mode 1

The number of pages and the wear amount at the end of lifetime of the photosensitive drum 1 in this example are listed in Tables 5 to 7 hereinbelow.

TABLE 5

| PAPER FEED MODE 1 | | |
|---|---|---|
| | NUMBER OF PAGES AT END OF LIFE IN IMAGE FORMING MODE 1 | NUMBER OF PAGES AT END OF LIFE IN IMAGE FORMING MODE 2 |
| CT = 12 μm | 42000 | 25000 |

TABLE 6

| PAPER FEED MODE 2 | | |
|---|---|---|
| | NUMBER OF PAGES AT END OF LIFE IN IMAGE FORMING MODE 1 | NUMBER OF PAGES AT END OF LIFE IN IMAGE FORMING MODE 2 |
| CT = 12 μm | 39000 | 23800 |

TABLE 7

| PAPER FEED MODE 3 | | |
|---|---|---|
| | NUMBER OF PAGES AT END OF LIFE IN IMAGE FORMING MODE 1 | NUMBER OF PAGES AT END OF LIFE IN IMAGE FORMING MODE 2 |
| CT = 12 μm | 40000 | 24200 |

In the case of the paper feed mode 1, the end of lifetime was notified at 25,000 pages in the image forming mode 2, and the end of lifetime was notified at 42,000 pages in the image forming mode 1 (Table 5).

In the case of the paper feed mode 2, the end of lifetime was notified as 23,800 pages in the image forming mode 2, and the end of lifetime was notified at 39,000 pages in the image forming mode 1 (Table 6).

In the case of the paper feed mode 3, the end of lifetime was notified at 24,200 pages in the image forming mode 2, and the end of lifetime was notified at 40,000 pages in the image forming mode 1 (Table 7).

According to the above test, it was confirmed that the drum lifetime was correctly notified only in the image forming mode 1, or only in the image forming mode 2. In the paper feed mode 3, the degree of wear of the photosensitive drum 1 changes before and after the switching of the image forming mode, but it was confirmed that the drum lifetime was notified at the correct timing after the image forming mode was switched to the image forming mode 2.

According to Embodiment 1 described above, reaching the end of lifetime in each image forming mode can be accurately determined, and notification can be performed based on this determination result.

In Embodiment 1, a mode in which the discharge current amount is high is generated by changing the applied bias. In the case when the discharge current amount is different, depending on the image forming mode, the degree of leaking changes accordingly, hence different lifetime thresholds must be provided. Thus the present invention has a plurality of image forming modes having mutually different discharge current amounts, that is, it is suitable to apply the present invention to an image forming apparatus which can execute a plurality of image forming modes.

Further, in an image forming mode in which the discharge current between the charging member and the photosensitive drum 1 is high during charging, the wear of the CT layer is accelerated. If the wear of the CT layer advances, dielectric breakdown (leakage) may be generated in the photosensitive drum, exceeding the dielectric capability thereof. Once leakage occurs to the photosensitive drum, the bias applied to the developing roller or the charging roller leaks to the resistance layer, and fogging may be generated by a charging failure or chipping of the image may be generated by a developing failure. To prevent this leakage, it is necessary to maintain a thick film thickness of the CT layer on the photosensitive drum. For example, the threshold of the film thickness, in a mode in which the discharging current amount is highest, is set as the threshold of the lifetime of the photosensitive drum. In other words, in all modes, the lifetime of the photosensitive drum is estimated using a single threshold. However, in this case, it may be determined that the lifetime of the photosensitive drum ended even if image forming can be performed in the other image forming modes. This is of no benefit to the user. According to Embodiment 1, on the other hand, an exchange of a cartridge is prompted at an appropriate timing for each image forming mode.

In Embodiment 1, a color tandem machine is used, but the same effect can be implemented even for a monochrome machine or a color machine which has only one drum in the main body.

In Embodiment 1, the wear amount of the photosensitive member is used as the lifetime threshold, but the lifetime threshold may be a value other than the wear amount, as long as the value is related to the driving amount of the photosensitive member (image bearing member).

For example, a cumulative number of rotations of the photosensitive member, a cumulative driving time of the photosensitive member or the image forming apparatus, a cumulative number of pages on which an image was formed, a power supplying time of the image forming apparatus or the like may be used.

Further, a number of rotations of the photosensitive member in the remaining lifetime, a driving time of the photosensitive member or the image forming apparatus in the remaining lifetime, a number of pages on which an image is formed in the remaining lifetime, and a power supplying time of the image forming apparatus in the remaining lifetime, for example, may be used. These values related to the remaining lifetime may be obtained by subtracting a cumulative value related to the driving amount from a predetermined value.

In Embodiment 1, the wear amount per unit time is used, but the unit time need not be used all the time. For example, an operating time or power supplying time of the image forming apparatus or the photosensitive member, a number of rotations of the photosensitive member, or a number of pages on which an image is formed may be used as the unit operation amount.

In the case of using a value other than the wear amount of the photosensitive member (value related to the driving amount of the photosensitive member) as the lifetime threshold, an appropriate value to compare with the lifetime threshold must be calculated based on operation history. This value is a value in accordance with the driving amount of the image bearing member. For example, a cumulative number of rotations of the photosensitive member, a cumulative driving time of the photosensitive member or the image forming apparatus, a cumulative number of pages on which an image is formed, or a power supplying time of the image forming apparatus may be used.

Embodiment 2

Embodiment 2 will be described next. Description on portions that are the same as Embodiment 1 will be omitted.

An image forming apparatus according to Embodiment 2 has an image forming mode (third image forming mode) in which a tinge selection range can be increased and high density can be acquired by changing the peripheral speed ratio between the photosensitive drum 1 and the developing roller 4 (hereafter "developing peripheral speed ratio"), in addition to the first image forming mode.

In Embodiment 2, the peripheral speed ratio is defined by (peripheral speed ratio)=(rotation speed of developing roller 4)/(rotation speed of photosensitive drum 1)×100(%).

Details of the image forming mode 3 will now be described. Table 8 indicates the relationship of image forming modes 1 and 3 and the applied biases.

TABLE 8

| | IMAGE FORMING MODE 1 | IMAGE FORMING MODE 3 |
|---|---|---|
| DARK POTENTIAL | −500 V | −800 V |
| LIGHT POTENTIAL | −100 V | −100 V |
| CHARGING BIAS | −1100 V | −1400 V |
| BLADE BIAS | −500 V | −800 V |
| DEVELOPING BIAS | −300 V | −600 V |
| DEVELOPING CONTRAST | −200 V | −500 V |

In the image forming mode 3, the photosensitive drum 1 rotates at 40 rpm, just like the image forming mode 1, and the developing roller 4 rotates at 200 rpm. In the image forming mode 1, the peripheral speed difference between the photosensitive drum 1 and the developing roller 4 is 156%, but this peripheral speed difference is 312% in the image forming mode 3, as indicated in Table 9.

As a result of setting the peripheral speed difference like this, the toner coating amount on the photosensitive drum 1, when a solid black image is formed, becomes double that in the image forming mode 1. In other words, a tinge selection range can be increased, and high density can be acquired.

TABLE 9

| | IMAGE FORMING MODE 1 | IMAGE FORMING MODE 3 |
|---|---|---|
| ROTATION SPEED OF PHOTOSENSITIVE DRUM [rpm] | 40 | 40 |
| ROTATION SPEED OF DEVELOPING ROLLER [rpm] | 100 | 200 |
| DEVELOPING PERIPHERAL SPEED RATIO [%] | 156 | 312 |

If the developing peripheral speed ratio is changed like this, a major difference is generated in the wear amount of the photosensitive drum 1 in the longitudinal direction. In Embodiment 2, to handle this problem, the threshold of the wear amount of the CT layer (organic photosensitive layer) of the photosensitive drum 1 is stored for each position on the photosensitive drum and for each image forming mode.

Further, in Embodiment 2, the wear amounts of the CT layer at a plurality of positions is estimated respectively, and the plurality of estimated wear amounts and a plurality of stored thresholds are compared, and the of the drum lifetime is notified when any one of the wear amounts reaches the threshold in each image forming mode.

In Embodiment 2, two types of models: a model of which initial CT layer film thickness of the photosensitive drum 1 is 14 μm; and a model of which initial CT layer film thickness thereof is 20 μm are provided. Recently large capacity cartridges are manufactured to decrease the cost per page of printing. In this case, two types of CT film thicknesses, one for the normal model and the other for the large capacity model, may be used, hence two types of models are provided in Embodiment 2.

Figure 5:
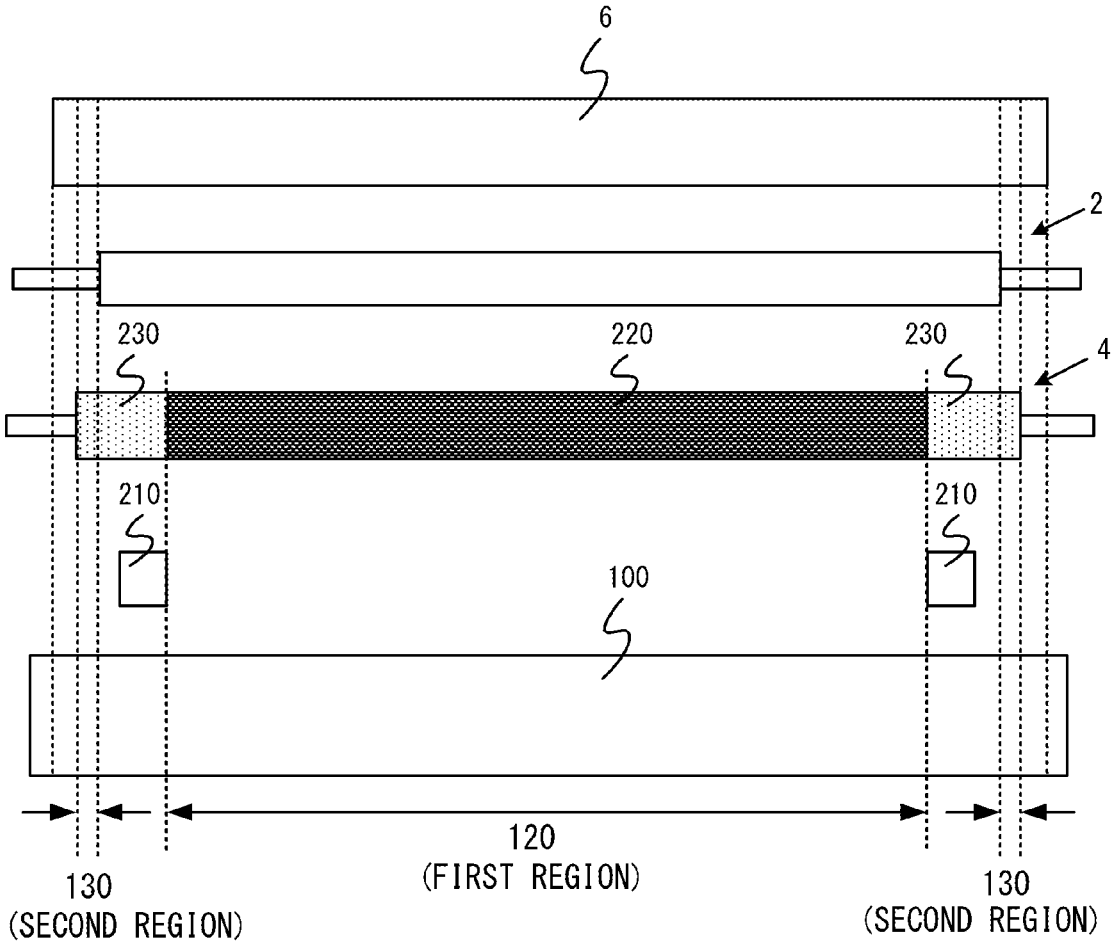
FIG. 5 is a schematic diagram depicting a longitudinal configuration of a photosensitive drum and a member that acts on the photosensitive drum.

FIG. 5 depicts a positional relationship of the drum, the charging roller, the developing roller and the cleaning blade of a known contact development type. FIG. 5 also depicts a positional relationship of the photosensitive drum 1 (image bearing member), the charging roller 2 (charging apparatus), the developing roller 4 (developer carrying member), the cleaning blade rubber portion 6 (cleaning member), and the toner seal 210 (toner sealing member).

On both ends of the developing roller 4, the toner seal 210, which is held between the developing apparatus frame and the developing roller 4, is disposed to prevent toner leakage from the developer containing chamber. Both ends of the developing roller 4 are pressed to this toner seal 210. Thereby the toner in the developer containing chamber is blocked, and toner leakage at both ends of the developing roller 4 is prevented.

In the developing roller 4, a developing roller region, located inward from the contact positions with the toner seals 210 on both ends, is a toner carrying region 220 (developer carrying region) where toner is carried on the developing roller 4. Each of the outer sides of the toner carrying region 220 is a toner non-carrying region 230 (developer non-carrying region), where toner is not carried on the developing roller 4.

Here, the surface region of the photosensitive drum 1, where the toner carrying region 220 of the developing roller 4 contacts (corresponds), is assumed to be the image forming region 120 (first region).

To downsize the process cartridge, the edges of the developing roller 4 are, in many cases, disposed within the cleaning blade rubber portion 6 in the longitudinal direction. Further, the edges of the developing roller 4 may be disposed 3 to 4 mm outside the end faces of the charging roller 2, as illustrated in FIG. 5. In these non-image forming regions, each region from the edge of the developing roller 4 to the edge of the charging roller is assumed to be the second region 130 respectively.

Further, the end face of the developing roller 4 and the end face of the charging roller 2 are also disposed within the region of the cleaning blade rubber portion 6 in many cases. In other words, the edge of the charging roller 2 and the edge of the developing roller 4 are in the scraping region of the cleaning blade rubber portion 6.

In the case of the configuration illustrated in FIG. 5, the wear amount of the CT layer of the photosensitive drum 1 is not uniform in the longitudinal direction of the photosensitive drum 1. In particular, the wear amount in the first region 120, corresponding to the toner carrying region 220 of the developing roller in the longitudinal direction, and that in the second regions 130 disposed in the end face of the developing roller 4 and the end face of the charging roller 2 in the toner non-carrying region 320, are different. Especially in each second region, where the outer diameter of the end face of the developing roller 4 increases from the inner side to the outer side in the longitudinal direction, assuming a horn shape, the drum wears more easily due to mechanical rubbing.

Therefore in Embodiment 2, the wear amount of the CT layer in the first region 120 of the photosensitive drum 1 (a region corresponding to the toner carrying region 220 of the developing roller 4) and that in each second region 130 of the photosensitive drum 1 (a region corresponding to the toner non-carrying region 230) are estimated respectively.

Then when either one of the total wear amount in the first region and the total wear amount in the second region reaches the threshold, the end of lifetime of the photosensitive drum 1 corresponding to each image forming mode is notified to the user via the display unit 21.

In Embodiment 2 as well, the wear amount per unit time is stored for each imaging forming mode in advance, and the total wear amount is calculated by multiplying the wear amount per unit time by the operation time in each image forming mode.

In Embodiment 2, the wear amount per unit time is determined not only by the discharge amount of the charging roller 2 to the photosensitive drum 1, but also by the peripheral speed ratio between the photosensitive drum 1 and the developing roller 4. Here the wear amount per unit time was determined for the image forming modes 1 and 3 by the following experiment. In Embodiment 2, the image forming apparatus was operated continuously for six hours in the image forming modes 1 and 3, under the abovementioned conditions. Then just like Embodiment 1, the film thickness of the photosensitive drum 1 at the longitudinal center measured before and immediately after the experiment using a film thickness measuring device (Permascope, made by Fisher).

First in the image forming mode, the required film thickness of the CT layer in the first region 120 of the photosensitive drum 1 was checked by experiment. As a result, it was observed that when the film thickness becomes less than 7 μm, the dark decay of VD of the photosensitive drum 1 accelerates, particularly under a high temperature and high humidity environment of at 30° C./80% or more. Therefore the CT film thickness at the end of live in the image forming mode 1 was set to 7.0 μm. Further, the film thickness of each second region 130 of the photosensitive drum 1 was set to 0 μm.

In the image forming mode 3, leakage occurred in the first region 120 when the CT film thickness is 9.0 μm just like the image forming mode 2 in Embodiment 1. Therefore the lifetime threshold in the first region 120 in the image forming mode 3 was set to 5.0 μm (=initial film thickness 14 μm−film thickness at end of lifetime 9 μm).

Further, in each second region 130 of the photosensitive drum 1, the relationship between the photosensitive drum film thickness and leakage was checked (Table 10). Since the charging roller does not exist in the second regions, possible leakage is only from the developing roller. However, leakage still occurred even when the CT film thickness is 1 μm, because the bias of the developing roller is higher than the case of the image forming mode 1. Hence the film thickness at the end of lifetime in each second region 130 was set to 1 μm in the image forming mode 3.

TABLE 10

| | OCCURRENCE OF LEAKAGE IN SECOND REGION | |
|---|---|---|
| FILM THICKNESS | IMAGE FORMING MODE 1 | IMAGE FORMING MODE 3 |
| 2 μm | NOT OCCURRED | NOT OCCURRED |
| 1 μm | NOT OCCURRED | OCCURRED |
| 0 μm | OCCURRED | OCCURRED |

Table 11 depicts results of calculating the wear amount (μm) after six hours of operation and the wear amount per unit time (per second) (wear coefficient) in image forming modes 1 and 3 respectively.

TABLE 11

| | | IMAGE FORMING MODE 1 | IMAGE FORMING MODE 3 |
|---|---|---|---|
| FIRST REGION | TOTAL WEAR AMOUNT AFTER 6 HOURS [μm] | 1.182 | 1.242 |
| | WEAR COEFFICIENT [μm/sec] | 0.0000328 (cc1) | 0.0000345 (cc2) |
| SECOND REGION | TOTAL WEAR AMOUNT AFTER 6 HOURS [μm] | 2.759 | 6.404 |
| | WEAR COEFFICIENT [μm/sec] | 0.0000766 (ec1) | 0.0001779 (ec1) |

The calculation to estimate the drum lifetime and determining the lifetime notification according to Embodiment 2 will be described next with specifics.

According to Embodiment 1, the lifetime threshold (first lifetime threshold) corresponding to the first image forming mode and the lifetime threshold (second lifetime threshold) corresponding to the second image forming mode are stored in the memory 55 disposed in the process cartridge. According to Embodiment 2, on the other hand, the threshold of the wear amount of the CT layer (organic photosensitive layer) of the photosensitive drum 1 is stored in the memory 55 disposed in the process cartridge for each image forming mode and for each position.

In other words, the lifetime notification is determined using the following four lifetime thresholds.

First lifetime threshold corresponding to first position in first image forming mode Second lifetime threshold corresponding to first position in second image forming mode Third lifetime threshold corresponding to second position in first image forming mode Fourth lifetime threshold corresponding to second position in second image forming mode By providing a plurality of thresholds corresponding to a plurality of image forming modes for each position (region) on the photosensitive drum like this, the lifetime can be determined with more accuracy.

According to Embodiment 2, the threshold SC of the wear amount in the first region 120 of the photosensitive drum 1, and the threshold SE of the wear amount in each second region 130 where wear amount is high, are stored.

Table 12 indicates the lifetime thresholds in each image forming mode according to Embodiment 2.

TABLE 12

| | IMAGE FORMING MODE 1 | | IMAGE FORMING MODE 2 | |
|---|---|---|---|---|
| | CENTER | EDGE | CENTER | EDGE |
| CT 14 μm PRODUCT | 7 μm | 14 μm | 5 μm | 13 μm |
| CT 20 μm PRODUCT | 13 μm | 20 μm | 11 μm | 19 μm |

When the photosensitive drum is the CT 14 μm product, the lifetime threshold SC1 of the first region 120 in the image forming mode 1 is 7 μm (=initial film thickness 14 μm−film thickness at end of lifetime 7 μm). The lifetime threshold SE1 of the second region 130 is 14 μm (=initial film thickness 14 μm−film thickness at end of lifetime 0 μm).

In the cartridge, the lifetime threshold corresponding to the CT film thickness of the photosensitive drum 1 is stored in the memory 55 for each image forming mode.

The memory 55 also stores the wear coefficient for each mode, as indicated in Table 13. The name of the wear coefficient is indicated inside parenthesis.

TABLE 13

| | | IMAGE FORMING MODE 1 | IMAGE FORMING MODE 3 |
|---|---|---|---|
| FIRST REGION | WEAR COEFFICIENT [μm/sec] | 0.0000328 (cc1) | 0.0000345 (cc3) |
| SECOND REGION | WEAR COEFFICIENT [μm/sec] | 0.0000766 (ec1) | 0.0001779 (ec3) |

Table 14 lists each item and name thereof.

TABLE 14

| | NAME |
|---|---|
| TOTAL WEAR AMOUNT IN FIRST REGION | SC |
| TOTAL WEAR AMOUNT IN SECOND REGION | SE |
| WEAR COEFFICIENT IN IMAGE FORMING MODE 1 (FIRST REGION) | cc1 |
| WEAR COEFFICIENT IN IMAGE FORMING MODE 1 (SECOND REGION) | ec1 |

TABLE 14-continued

| | NAME |
|---|---|
| WEAR COEFFICIENT IN IMAGE FORMING MODE 3 (FIRST REGION) | cc3 |
| WEAR COEFFICIENT IN IMAGE FORMING MODE 3 (SECOND REGION) | cc3 |
| DRIVING TIME IN IMAGE FORMING MODE 1 | t1 |
| DRIVING TIME IN IMAGE FORMING MODE 3 | t3 |
| LIFE THRESHOLD IN IMAGE FORMING MODE 1 (FIRST REGION) (= INITIAL FILM THICKNESS − FILM THICKNESS AT END OF LIFE) | SC1 |
| LIFE THRESHOLD IN IMAGE FORMING MODE 1 (SECON REGION) (= INITIAL FILM THICKNESS − FILM THICKNESS AT END OF LIFE) | SE1 |
| LIFE THRESHOLD IN IMAGE FORMING MODE 3 (FIRST REGION) (= INITIAL FILM THICKNESS − FILM THICKNESS AT END OF LIFE) | SC3 |
| LIFE THRESHOLD IN IMAGE FORMING MODE 3 (SECOND REGION) (= INITIAL FILM THICKNESS − FILM THICKNESS AT END OF LIFE) | SE3 |

The calculation of the wear amount performed by the wear amount calculating unit 59*a* and the determination of the end of lifetime will be described next with reference to the flow chart in FIG. 6.

Figure 6:
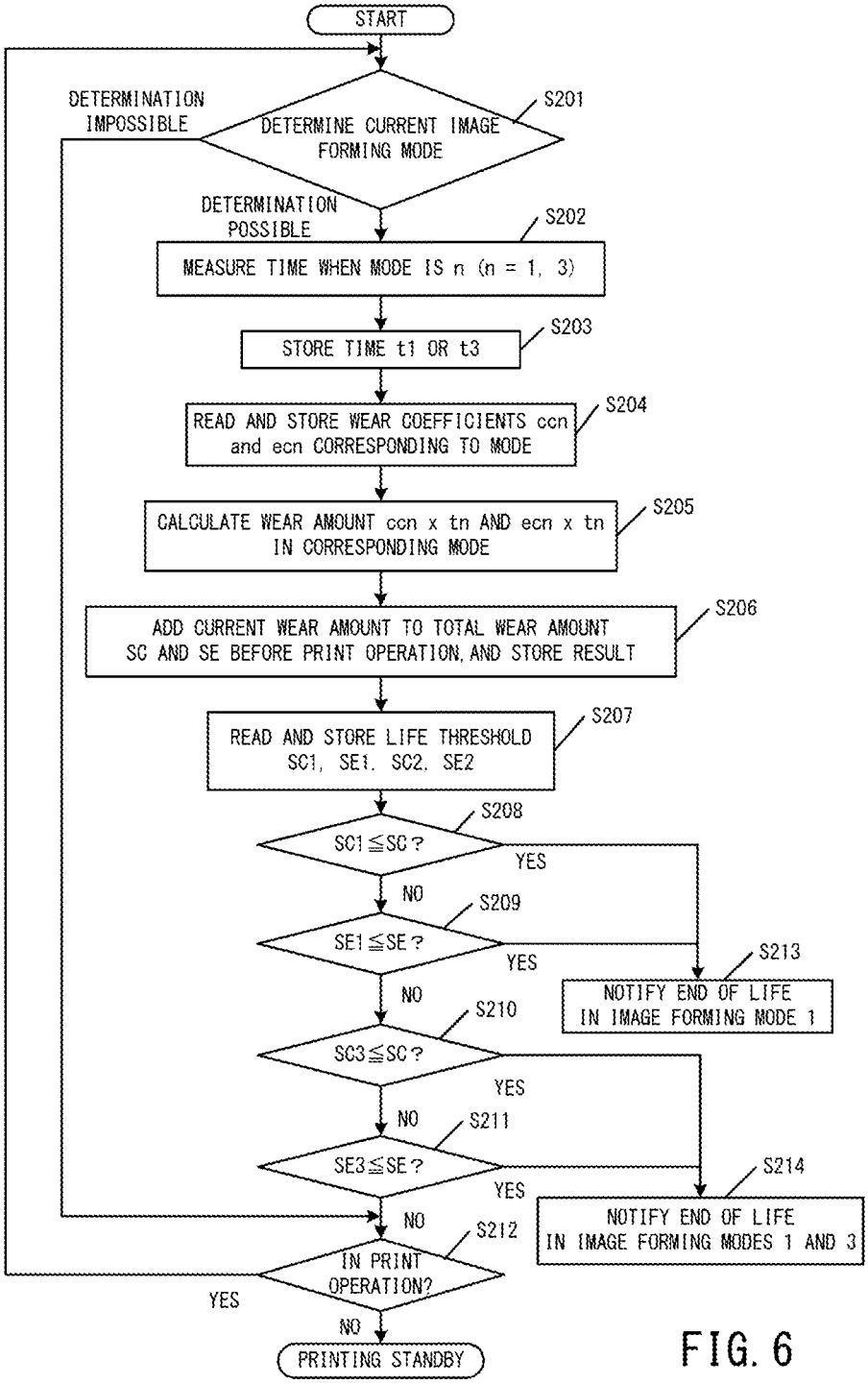
FIG. 6 is a flow chart depicting a processing to determine the lifetime of the drum according to Embodiment 2.

FIG. 6 is a flow chart depicting the operation of the image forming apparatus 100 to determine the end of lifetime of the photosensitive drum, after the image forming apparatus 100 received the print request in the print operation standby state.

First, in step S201, the wear condition detecting unit 57 determines the current image forming mode. If the image forming mode is determined, processing advances to step S202. If the image forming mode cannot be determined, processing advances to step S212.

In step S202, the time operated in the mode n (n is either 1 or 3) determined in step S201 is measured by the time measuring unit 58. The measured driving time tn is stored in the wear amount calculating unit 59*a* (step S203).

In step S204, the image forming apparatus 100 reads the wear coefficients ccn and ecn corresponding to the determined mode n (n=1, 3) from the memory 55, and stores the wear coefficient in the wear amount calculating unit 59*a*.

In step S205, the wear amount calculating unit 59*a* calculates the wear amount in each mode ccn×tn and ecn×tn (n=1, 3).

In step S206, the total wear amount calculating unit 59*b* reads the total wear amounts SC (first region) and SE (second regions) before the print operation from the memory 55, and adds the wear amounts this time respectively, to update the total wear amounts SC and SE, and stores the result to the memory 55 and the comparing unit 60.

The updated SC and SE are given by the following expressions.

$$\text{Updated } SC=SC+ccn\times tn \ (n=1,3)$$

$$\text{Updated } SE=SE+ecn\times tn \ (n=1,3)$$

In step S207, the comparing unit 60 reads the lifetime thresholds SC1, SE, SC2 and SE2 from the memory 55, and stores these lifetime thresholds.

In step S208, the comparing unit 60 determines whether SC1≤SC. If YES, processing advances to step S213. If NO, processing advances to step S209.

In step S209, the comparing unit 60 determines whether SE1≤SE. If YES, processing advances to step S213. If NO, processing advances to step S210.

In step S210, the comparing unit 60 determines whether SC3≤SC. If YES, processing advances to step S214. If NO, processing advances to S211.

In step S211, the comparing unit 60 determines whether SE3≤SE. If YES, processing advances to step S214. If NO, processing advances to step S212.

If the processing advances to step S212, the lifetime of the photosensitive drum is not notified. Here it is determined whether the image forming apparatus 100 is in the print operation, and if YES, processing advances to step S101. If NO, the image forming apparatus 100 enters the print operation standby state.

In step S213, operation of the image forming apparatus 100, such as driving and applying bias, is sequentially stopped, and information that the drum lifetime ended (lifetime ended in both the first and third image forming modes) is displayed on the display unit 21 based on the instruction of the control unit 50.

Further, in step S214, operation of the image forming apparatus 100, such as driving and applying bias, is sequentially stopped, and information that the drum lifetime ended (lifetime ended in the third image forming mode) is displayed on the display unit 21 based on the instruction of the control unit 50.

Using this photosensitive drum lifetime estimating method, the image forming apparatus 100 was operated in each of the following paper feed modes, and a number of pages at the end of the drum lifetime, a lifetime ended region (first region 120 or second region 130), and a total wear amount of the first and second regions were checked.

Paper feed mode 1: uses only image forming mode 1

Paper feed mode 2: uses only image forming mode 2

Paper feed mode 3: switched to image forming mode 3 after printing 10,000 pages in image forming mode 1

The number of pages and the wear amount at the end of the lifetime of the photosensitive drum 1 in this example are listed in Tables 15 to 17 hereinbelow.

TABLE 15

| PAPER FEED MODE 1 | | | | | |
|---|---|---|---|---|---|
| LIFE IN IMAGE FORMING MODE 1 | | | | | |
| | NUMBER OF | | TOTAL WEAR | WEAR AMOUNT AT END OF LIFE [μm] | |
| MODEL | PAGES AT END OF LIFE | LIFE-ENDED REGION | AMOUNT OF LIFE-ENDED REGION [μm] | FIRST REGION SC0 | SECOND REGION SE0 |
| CT 14 μm | 50000 | SECOND REGION | 14 | 6 | 14 |
| CT 20 μm | 71000 | SECOND REGION | 20 | 8.5 | 20 |

TABLE 15-continued

| PAPER FEED MODE 1 | | | | | |
|---|---|---|---|---|---|
| LIFE IN IMAGE FORMING MODE 3 | | | | | |
| | NUMBER OF | | TOTAL WEAR | WEAR AMOUNT AT END OF LIFE [μm] | |
| MODEL | PAGES AT END OF LIFE | LIFE-ENDED REGION | AMOUNT OF LIFE-ENDED REGION [μm] | FIRST REGION SC0 | SECOND REGION SE0 |
| CT 14 μm | 42000 | FIRST REGION | 5 | 5 | 11.9 |
| CT 20 μm | 68000 | SECOND REGION | 19 | 8.1 | 19 |

TABLE 16

| PAPER FEED MODE 2 | | | | | |
|---|---|---|---|---|---|
| LIFE IN IMAGE FORMING MODE 1 | | | | | |
| | NUMBER OF | | TOTAL WEAR | WEAR AMOUNT AT END OF LIFE [μm] | |
| MODEL | PAGES AT END OF LIFE | LIFE-ENDED REGION | AMOUNT OF LIFE-ENDED REGION [μm] | FIRST REGION SC0 | SECOND REGION SE0 |
| CT 14 μm | 22000 | SECOND REGION | 14 | 6 | 14 |
| CT 20 μm | 30000 | SECOND REGION | 20 | 5.8 | 20 |
| LIFE IN IMAGE FORMING MODE 3 | | | | | |
| | NUMBER OF | | TOTAL WEAR | WEAR AMOUNT AT END OF LIFE [μm] | |
| MODEL | PAGES AT END OF LIFE | LIFE-ENDED REGION | AMOUNT OF LIFE-ENDED REGION [μm] | FIRST REGION SC0 | SECOND REGION SE0 |
| CT 14 μm | 20000 | SECOND REGION | 13 | 2.5 | 13 |
| CT 20 μm | 29000 | SECOND REGION | 19 | 3.7 | 19 |

TABLE 17

| PAPER FEED MODE 3 | | | | | |
|---|---|---|---|---|---|
| LIFE IN IMAGE FORMING MODE 1 | | | | | |
| | NUMBER OF | | TOTAL WEAR | WEAR AMOUNT AT END OF LIFE [μm] | |
| MODEL | PAGES AT END OF LIFE | LIFE-ENDED REGION | AMOUNT OF LIFE-ENDED REGION [μm] | FIRST REGION SC0 | SECOND REGION SE0 |
| CT 14 μm | 27000 | SECOND REGION | 14 | 3.4 | 14 |
| CT 20 μm | 36000 | SECOND REGION | 20 | 4.5 | 20 |

TABLE 17-continued

| PAPER FEED MODE 3 | | | | | |
|---|---|---|---|---|---|
| LIFE IN IMAGE FORMING MODE 3 | | | | | |
| | NUMBER OF | | TOTAL WEAR | WEAR AMOUNT AT END OF LIFE [μm] | |
| MODEL | PAGES AT END OF LIFE | LIFE-ENDED REGION | AMOUNT OF LIFE-ENDED REGION [μm] | FIRST REGION SC0 | SECOND REGION SE0 |
| CT 14 μm | 26000 | SECOND REGION | 13 | 3.3 | 13 |
| CT 20 μm | 35000 | SECOND REGION | 19 | 4.4 | 19 |

In the case of the paper feed mode 1, the end of lifetime of the CT 14 μm model was notified at 42,000 pages in the first region in the image forming mode 3, and the end of lifetime thereof was notified at 50,000 pages in the second region in the image forming mode 1. The end of lifetime of the CT 20 μm model was notified at 68,000 pages in the second region in the image forming mode 3, and the end of lifetime thereof was notified at 71,000 pages in the second region in the image forming mode 1 (Table 15).

In the case of the paper feed mode 2, the end of lifetime of the CT 14 μm model was notified at 20,000 pages in the second region in the image forming mode 3, and the end of lifetime thereof was notified at 22,000 pages in the second region in the image forming mode 1. The end of lifetime of the CT 20 μm model was notified at 29,000 pages in the second region in the image forming mode 3, and the end of lifetime was notified at 30,000 pages in the second region in the image forming mode 1 (Table 16).

In the case of the paper feed mode 3, the end of lifetime of the CT 14 μm model was notified at 26,000 pages in the second region in the image forming mode 3, and the end of lifetime thereof was notified at 27,000 pages in the second region in the image forming mode 1. The end of lifetime of the CT 20 μm model was notified at 35,000 pages in the second region in the image forming mode 3, and the end of lifetime thereof was notified at 36,000 pages in the second region in the image forming mode 1 (Table 17).

According to the above test, it was confirmed that the drum lifetime was correctly notified only in the image forming mode 1, or only in the image forming mode 3. In the paper feed mode 3, the first region 120 of the photosensitive drum 1 wears more by printing in the image forming mode 1, but it was confirmed that after the image forming mode is switched to the image forming mode 3, the lifetime of each second region 130 ends before the first region 120.

According to Embodiment 2 described above, it is assumed that the wear amount per unit time is determined not only by the discharging amount of the charging roller 2 to the photosensitive drum 1, but also by the peripheral speed ratio between the photosensitive drum 1 and the developing roller 4. However, in Embodiment 2, the discharging amount of the charging roller 2 to the photosensitive drum 1 may be the same in the image forming mode 1 and the image forming mode 3, and only the peripheral speed ratio may be different in the image forming mode 1 and the image forming mode 3. In this case, the wear coefficient in the image forming mode 3 becomes smaller, but it still greater than the wear coefficient in the image forming mode 1. If this wear coefficient is stored in the memory 55 and the image forming apparatus 100 executes the flow chart in FIG. 6 based on the stored information, the same effect as the above description can still be obtained.

Embodiment 3

Embodiment 3 will be described next. Description on portions that are the same as Embodiments 1 and 2 will be omitted.

An image forming apparatus according to Embodiment 3 has a third image forming mode, in which the developing peripheral speed ratio is different from the first image forming mode, just like Embodiment 2. In addition, in Embodiment 3, the wear amount in each second region changes in accordance with the hardness of the developing roller 4.

In Embodiment 3, the hardness of the developing roller was measured using a micro-hardness meter MD-1, made by Kobunshi Keiki Co. Ltd. Further, in Embodiment 3, two types of developing rollers 4, of which the MD-1 hardness is 44 and 36.5°, were provided.

Figure 7:
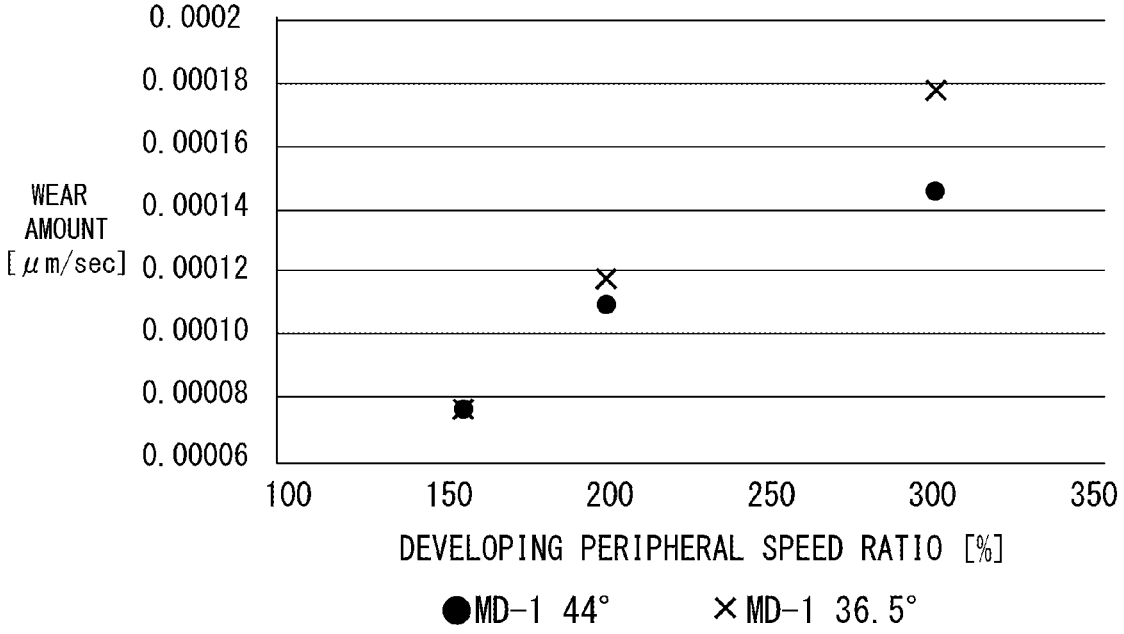
FIG. 7 is a diagram depicting a relationship of a developing peripheral speed ratio, a roller hardness and a drum wear amount.

FIG. 7 is a graph depicting the wear amount in the second region. As this result indicates, as the hardness of the developing roller 4 decreases, the wear amount increases when the developing peripheral speed ratio is increased. This is because as the developing roller 4 becomes softer, distortion in the portion in contact with the photosensitive drum 1 increases and the wear amount increases when the peripheral speed ratio is large.

In Embodiment 3, the wear coefficient based on the hardness is stored in the memory 55. By storing correct wear coefficients, the end of lifetime in each image forming mode can be accurately detected and notified to the user.

Even in the case when the MD-1 hardness is different depending on each process cartridge, the end of lifetime in each image forming mode can be accurately detected and notified to the user by storing the wear coefficient corresponding to each MD-1 hardness in the memory 55 in advance.

Embodiment 4

Embodiment 4 will be described next. Description on portions that are the same as Embodiments 1 to 3 will be omitted. Embodiment 4 is characterized in that the photosensitive drum lifetime estimating unit performs an operation related to lifetime determination that is different from Embodiments 1 to 3.

Photosensitive Drum Lifetime Estimating Unit

The photosensitive drum lifetime estimating unit will be described next with specifics. The image forming apparatus 100 according to Embodiment 4 as well stores the threshold of the wear amount of the CT layer (organic photosensitive layer) of the photosensitive drum 1 in the memory 55 (storage unit), as a value related to the driving amount of the photosensitive member (image bearing member). The control unit 50 (wear amount calculating unit 59*a*, total wear amount calculating unit 59*b*) of the image forming apparatus 100 sets a value related to the first driving amount in the image forming mode 1 to be compared with the threshold, based on the value related to the driving amount of the photosensitive member stored in the memory 55. Further, the control unit 50 sets a value related to the second driving amount in the image forming mode 2 to be compared with the threshold, based on the value related to the driving amount of the photosensitive member stored in the memory 55. In the following, a case of using a value based on the wear amount of the CT layer as a value related to the first and second driving amount will be described. A value related to the first and second driving amount may be a value indicating the total driving amount or a value indicating the remaining lifetime driving amount.

When a value determined by multiplying the estimated wear amount of the photosensitive drum by the conversion coefficient in accordance with the image forming mode reaches the threshold, the image forming apparatus 100 notifies the user that the drum lifetime ended in this image forming mode. The notifying unit is the same as that of Embodiments 1 to 3.

In Embodiment 4, the end of the lifetime film thickness 7.0 μm in the image forming mode 1 is set as the reference lifetime value. Then just like steps S102 to S106 in Embodiment 1, the film thickness of the remaining CT layer of the photosensitive drum 1 is calculated from the estimated wear amount. Then the control unit 50 multiplies this calculated value by the conversion coefficient in each image forming mode. The conversion coefficient in the image forming mode 1 is assumed to be 1.0, and the conversion coefficient in the image forming mode 2 is assumed to be 0.78. The 0.78 conversion coefficient in the image forming mode 2 corresponds to the ratio of the actual lifetime threshold in the image forming mode 2 with respect to the threshold that is set. The actual lifetime threshold in the image forming mode 2 is 9.0 μm. However, the lifetime threshold that is actually used is 7.0 μm, so the end of lifetime should be determined at an earlier timing. Therefore the control unit 50 determines the end of lifetime at an earlier timing by multiplying the calculated CT film thickness by the conversion coefficient.

Table 18 indicates the result of the lifetime determination calculation.

TABLE 18

| | | IMAGE FORMING MODE 1 | | IMAGE FORMING MODE 2 | |
|---|---|---|---|---|---|
| CT FILM THICKNESS | LIFE THRESHOLD | CT FILM THICKNESS × CONVERSION COEFFICIENT (1.0) | LIFE DETERMINATION | CT FILM THICKNESS × CONVERSION COEFFICIENT (0.78) | LIFE DETERMINATION |
| 10 μm | 7 | 10 | NOT REACH | 7.8 | NOT REACH |
| 9 μm | | 9 | NOT REACH | 7.02 | REACH |
| 8 μm | | 8 | NOT REACH | 6.24 | REACH |
| 7 μm | | 7 | REACH | 5.46 | REACH |

As indicated in Table 2, the lifetime can be accurately determined ("REACH" the end of lifetime or "NOT REACH" the end of lifetime) in the image forming mode 2, even when the lifetime threshold is the same. 0.78 in Table 18 is a conversion coefficient corresponding to the image forming mode 2, and the control unit 50 multiplies the calculated CT film thickness by this conversion coefficient. Thereby the control unit 50 assumes that the photosensitive drum 1 operated more than the actual value in the image forming mode 2, an determines the lifetime accurately in the image forming mode 2, even if the lifetime threshold value that is lower than the actual lifetime threshold is used for comparison. Furthermore, the control unit 50 can allow the continuous operation of the image forming apparatus in the image forming mode 1, even if the end of lifetime is notified in the image forming mode 2, as indicated in steps S111 and later in FIG. 4.

Further, even in the calculations indicated in the following Table 19 and Table 20, the control unit 50 can determine the lifetime accurately just like the case of Table 18.

TABLE 19

| | | IMAGE FORMING MODE 1 | | IMAGE FORMING MODE 2 | |
|---|---|---|---|---|---|
| CT FILM THICK-NESS | LIFE THRESH-OLD | CT FILM THICKNESS × CONVERSION COEFFICIENT (1.29) | LIFE DETERMI-NATION | CT FILM THICKNESS × CONVERSION COEFFICIENT (1.0) | LIFE DETERMI-NATION |
| 10 μm | 9 | 12.9 | NOT REACH | 10 | NOT REACH |
| 9 μm | | 11.61 | NOT REACH | 9 | REACH |
| 8 μm | | 10.32 | NOT REACH | 8 | REACH |
| 7 μm | | 9.03 | REACH | 7 | REACH |

TABLE 20

| | | IMAGE FORMING MODE 1 | | IMAGE FORMING MODE 2 | |
|---|---|---|---|---|---|
| CT FILM THICK-NESS | LIFE THRESH-OLD | CT FILM THICKNESS × CONVERSION COEFFICIENT (2.86) | LIFE DETERMI-NATION | CT FILM THICKNESS × CONVERSION COEFFICIENT (2.22) | LIFE DETERMI-NATION |
| 10 μm | 20 | 28.6 | NOT REACH | 22.2 | NOT REACH |
| 9 μm | | 25.74 | NOT REACH | 19.98 | REACH |
| 8 μm | | 22.88 | NOT REACH | 17.76 | REACH |
| 7 μm | | 20.02 | REACH | 15.54 | REACH |

In Table 19, the reference of the lifetime threshold is the CT film thickness (9.0 μm) at which the end of lifetime is determined in the image forming mode 2. In Table 20, the reference of the lifetime threshold is a value which is not related to the CT film thickness at which the end of lifetime is determined in the image forming modes 1 and 2.

In this way, the values related to the first and second driving amounts are determined for the image forming modes 1 and 2 by multiplying the CT film thickness by the conversion coefficient corresponding to each image forming mode respectively, and are compared with a common reference threshold, whereby the lifetime in each mode can be accurately determined.

Embodiment 5

According to Embodiment 1 to 4, the end of lifetime of the photosensitive drum in a certain image forming mode is notified to the user. According to Embodiment 5, however, after the end of lifetime is notified, the use of the corresponding image forming mode is restricted.

Figure 8A:
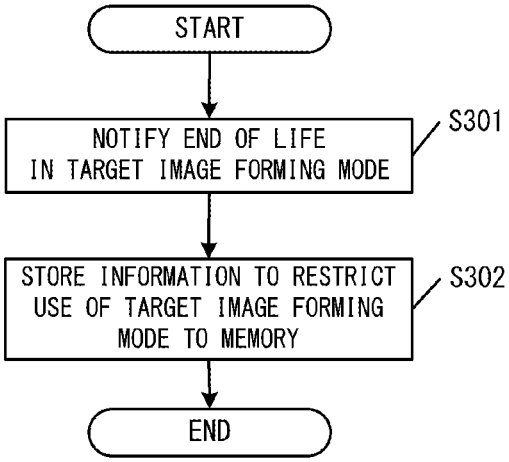
FIGS. 8A and 8B are flow charts depicting a processing to restrict the image forming mode according to Embodiment 4.

In Embodiment 5, the processing in FIG. 8A is executed in steps to notify the end of lifetime of the photosensitive drum (steps S111, S112, S213, S214).

First in step S301, the lifetime of the photosensitive drum in the target image forming mode is notified to the user. Step S301 corresponds to steps S111, S112, S213 and S214.

Then in step S302, information to restrict use of the target image forming mode is generated and stored in the memory 55 of the corresponding cartridge.

Figure 8B:
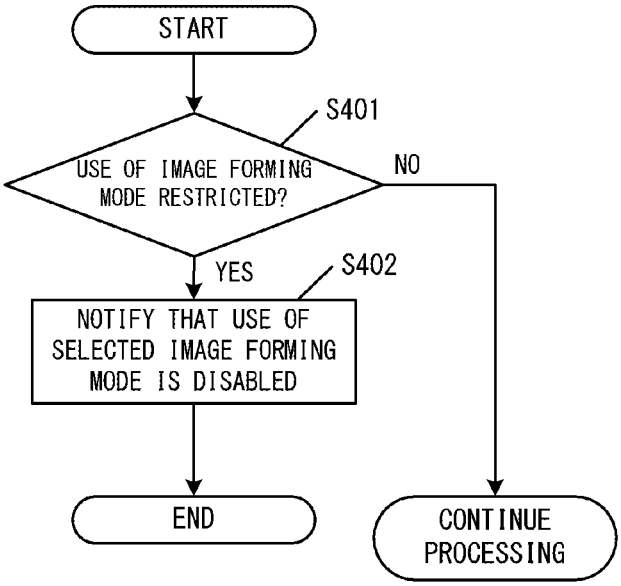

Further, in Embodiment 5, the processing in FIG. 8B is executed by the control unit 50 after receiving the print request. The processing is executed immediately after step S101 or step S201.

First in step S401, the control unit 50 refers to the information stored in the memory 55 included in each cartridge, and determines whether there is a cartridge of which use is restricted in the selected image forming mode.

If this determination result is YES, a message indicating that the use of the selected image forming mode is disabled is displayed on the display unit 21 (not illustrated) based on the instruction of the control unit 50 (step S402).

If the determination result is NO, the image forming processing continues.

According to Embodiment 5, if there is an image forming mode in which the lifetime of the photosensitive drum ended, the use of this image forming mode can be restricted. Image forming modes other than the image forming mode in which the end of lifetime is notified can be continuously used. Therefore the photosensitive drum can be effectively used until the appropriate timing of the lifetime.

Other Embodiments

Each of the above embodiments is an example that describes the present invention, and the present invention may be carried out by appropriately changing or combining these embodiments within a scope not departing from the essence of the invention.

For example, the present invention may be carried out as an image forming apparatus which includes at least a part of the abovementioned units. Further, the present invention may be carried out as an image forming method which performs at least a part of the above processing. The above processing and units may be freely combined as long as no technical inconsistency is generated.

The present invention may be carried out by providing a program which implements at least one function of the abovementioned embodiments to a system or apparatus via a network or storage medium, and at least one processor on a computer of the system or apparatus, reading and executing the program. The present invention may be carried out by a circuit (e.g. ASIC) which implements at least one function of the above embodiments.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-190419, filed on Sep. 29, 2017 and Japanese Patent Application No. 2018-124769, filed on Jun. 29, 2018, which are hereby incorporated by reference herein in their entireties.

What is claimed is:

1. An image forming apparatus comprising:

a plurality of image forming portions, each image forming portion of the plurality of image forming portions including a rotatable image bearing member, a charging member configured to charge a surface of the rotatable image bearing member, and a developer carrying member configured to develop the surface of the rotatable image bearing member by a developer;

an exposing unit configured to expose the respective charged surfaces of the rotatable image bearing members to form electrostatic latent images on the surfaces of the rotatable image bearing members;

a developing voltage applying unit configured to apply a developing voltage to the developer carrying members;

a controller configured to (i) perform a plurality of image forming modes including a first image forming mode for forming an image by using the plurality of image forming portions and a second image forming mode for forming the image by using the plurality of image forming portions, (ii) determine a lifetime corresponding to the first image forming mode and the second image forming mode based on a driving amount of the first image forming mode and a driving amount of the second image forming mode, and (iii) control the exposing unit and the developing voltage applying unit so that a second potential difference between the developing voltage of the second image forming mode and a light potential of the second image forming mode is larger than a first potential difference between the developing voltage of the first image forming mode and a light potential of the first image forming mode; and (iv) allow an operation in the first image forming mode after a first notification on a first restriction of the operation in the second image forming mode is performed based on the driving amount of the first image forming mode and the driving amount of the second image forming mode.

2. The image forming apparatus according to claim 1, wherein, for each of at least one image forming portion of the plurality of image forming portions, a peripheral speed ratio determined by dividing a rotation speed of the developer carrying member by a rotation speed of the rotatable image bearing member in the second image forming mode is larger than a peripheral speed ratio determined by dividing a rotation speed of the developer carrying member by a rotation speed of the rotatable image bearing member in the first image forming mode.

3. The image forming apparatus according to claim 1, wherein the lifetime is determined based on the value of the driving amount of the image bearing member.

4. The image forming apparatus according to claim 3, wherein a wear amount of the image bearing member is used as the lifetime threshold.

5. The image forming apparatus according to claim 3, wherein the value of the driving amount of the image bearing member is a value based on a number of rotations of the image bearing member.

6. The image forming apparatus according to claim 3, wherein the value of the driving amount of the image bearing member is a value based on a driving time of the image bearing member or the image forming apparatus.

7. The image forming apparatus according to claim 3, wherein the value of the driving amount of the image bearing member is a value based on a number of pages on which an image is formed.

8. The image forming apparatus according to claim 3, wherein the value of the driving amount of the image bearing member is a value based on a power supplying time of the image forming apparatus.

* * * * *